US005540167A

United States Patent [19]

Müssig et al.

[11] Patent Number: 5,540,167

[45] Date of Patent: Jul. 30, 1996

[54] PIPING-FITTED CLOTH POUCH AND METHOD AND EQUIPMENT FOR ITS MANUFACTURE

[75] Inventors: Karl Müssig; Martin Schnaus, both of Bad Königshofen, Germany

[73] Assignee: TEXPA-ARBTER Maschinenbaugesellschaft mbH, Saal/Saale, Germany

[21] Appl. No.: 312,737

[22] Filed: Sep. 27, 1994

[30] Foreign Application Priority Data

Sep. 27, 1993 [DE] Germany ..... 43 32 863.6

[51] Int. Cl.[6] ..... D05B 1/22; D05B 13/00; D05B 35/06

[52] U.S. Cl. ..... 412/475.09; 112/139; 112/153; 112/235; 112/152; 112/418; 112/10

[58] Field of Search ..... 112/2.1, 10, 46, 112/52, 470.27, 139, 182, 475.14, 417, 418, 419, 429, 441, 475.09; 2/247, 248, 255, 267, 275; 150/127, 128, 129, 130, 146

[56] References Cited

U.S. PATENT DOCUMENTS

| | | | |
|---|---|---|---|
| 221,801 | 11/1879 | Felt | 112/139 |
| 490,103 | 1/1893 | Collins | 112/10 X |
| 1,314,408 | 8/1919 | Lewis | 112/417 |
| 2,659,421 | 11/1953 | Wass et al. | 112/417 X |
| 3,867,890 | 2/1975 | Hamilton et al. | 112/139 |
| 4,214,541 | 7/1980 | Zeigler, Jr. et al. | 112/10 X |
| 4,784,248 | 11/1988 | Workman | 112/419 X |
| 4,932,506 | 6/1990 | Kim | 150/128 X |

FOREIGN PATENT DOCUMENTS

| | | | |
|---|---|---|---|
| 1803738 | 10/1968 | Germany | 112/139 |
| 3326783C1 | 3/1985 | Germany . | |
| 3624994A1 | 2/1988 | Germany . | |
| 3818796C1 | 11/1989 | Germany . | |
| 3737469C2 | 11/1989 | Germany . | |
| 3730406C2 | 2/1991 | Germany . | |
| 3332213C2 | 7/1992 | Germany . | |

*Primary Examiner*—Ismael Izaguirre
*Attorney, Agent, or Firm*—Lowe, Price, LeBlanc & Becker

[57] ABSTRACT

A method for manufacturing a sealable cloth pouch having an opening on one side and consisting of two cloth parts to be sewn together uses several piping segments corresponding in number and length essentially to the edges of the cloth pouch which is to be stitched. The seams of the cloth pouch runs substantially linearly along the edges of the pouch into the corners thereof but not around the corners. The piping segments overlap each other in the corner areas to create substantially rounded edges. The apparatus for manufacturing the cloth pouch includes a device to feed the cloth parts together, a device to insert the various piping segments, a device to stitch the piping segments and a device to create an incision to facilitate overlapping the piping segments.

14 Claims, 4 Drawing Sheets

PIPING-FITTED CLOTH POUCH AND METHOD AND EQUIPMENT FOR ITS MANUFACTURE

FIELD OF THE INVENTION

The invention concerns a method and equipment for manufacturing a unilaterally open, sealable cloth pouch, consisting of two sewn-together cloth parts with an essentially peripheral piping sewed onto the edges, as defined in the preambles of claims 1 or 10.

Furthermore the invention relates to a sealable cloth pouch open at one end defined in the preamble of claim 14.

The concept of "cloth pouch" in the sense of the present invention covers any kind of unilaterally open, sack-like pouches, for instance pillows, bed tickings, quilts, covers of all kinds, in particular pillow and bed coverings, and the like, which, upon insertion of the filling, illustratively down, are sealed permanently or in reopenable manner.

The expression "piping" is construed in this invention as being any insert in the seam between the two cloth parts and the filling therein, said piping at least slightly projecting in the finished state of the cloth pouch beyond the edge of the seam and optically covering the seam for improved sightliness.

BACKGROUND ART

As a rule cloth pouches of this species are sewn in such a manner that the two cloth parts forming the pouch are first stitched together in an inside-out manner and then are turned so that the outsides are visible in their final. When stitching the two cloth parts forming the pouch, the piping simultaneously inserted into the gap between the cloth parts is also stitched, the piping edge that shall face outward in the final state first pointing into the cloth pouch. In the known cloth pouches, this piping consists of a single continuous piping band of which the length substantially corresponds to the sum of the edges to be stitched together, that is to the total length of the edge of the cloth pouch except for the open side.

Following stitching and everting, these known cloth pouches evince a sightly and functionally satisfactory seam both along the edges and in the corners of the cloth pouch. In particular as regards rationalized and especially economical mass production, the known cloth pouches however incur the drawback that at least near the edges, they must be guided manually through the sewing machine in order to assure a clean-running stitch that shall reliably seal the cloth pouch and shall reliably affix the piping.

SUMMARY OF THE INVENTION

In the light of this state of the art, it is the object of the present invention to create a cloth pouch of the above species, further equipment and a method for its manufacture allowing economic production with high automation and simultaneously an esthetically satisfactory seam and piping even at the edges.

This problem is solved by means of the disclosure of of the inventive method, apparatus and cloth pouch as described below.

Advantageous embodiment modes of the invention are objects of the sub-claims.

The basic concept of the present invention is to simplify the handling during the stitching of a cloth pouch of the above species in that, contrary to the case of the state of the art, seams no longer shall be present around the pouch corners but merely shall run substantially linearly along the edges of this pouch. In other words, in the invention, stitching no longer takes place "around the corners" but instead only along the edges "into the corners". By this step alone handling already is substantially simplified and in particular automated fabrication is made possible in a suitable equipment.

In order to obtain an esthetically pleasing and adequate functional configuration of seam and piping despite this angular abutment of the seams and in particular the angular configuration of the stitched piping in the vicinity of the corners, another essential feature of the invention provides that this piping no longer shall be an integral piping band but instead shall consist of several piping segments corresponding in number and length essentially to the edges of the cloth pouch which must be sealed, i.e, stitched. In other words, the piping neither shall be guided in sealed manner around the edges of the cloth pouch, but instead the piping segments shall only be inserted into the edge zones. It is imperative in this respect that the piping segments shall not merely abut each other at more or less obtuse angles, but that they shall mutually overlap. Thereby no gap shall arise between the abutting piping segments near these corners when the pouch has been everted, rather rounded edges shall be created which correspond in aesthetic and functional manner to those rounded edges created for a cloth pouch manufactured in the prior art.

The invention comprises the following method stages.

In the first place a first piping segment is inserted into the two cloth parts positioned in an inside-out manner along a first lateral edge of the cloth pouch that in particular is opposite the open side of this pouch, and this piping is inserted or supplied in such manner that the first piping edge, which in a turned condition will point outward, initially points inward, and in that the opposite piping edge, which in a turned condition points inward, essentially terminates flush with the outer edge of the cloth pouch. Thereupon this first piping segment is stitched between its first and second edges to the two cloth parts, the corresponding lateral edge of the cloth pouch being sealed at the same time.

After the first piping segment has been stitched over its full length, the corresponding edge of the cloth pouch also is completely sealed. In other words, the further piping segments being inserted between the two cloth parts and abutting the first piping segment near the corners at more or less obtuse angles cannot be directly deposited in overlapping manner on the first piping segment or be made to pass underneath it but instead will abut the piping seam. In order to nevertheless achieve the desired overlap of the piping ends, the invention provides that any one of the two cloth parts will be incised along the piping seam, i.e. parallel to it, from both of the lateral edges of the cloth pouch adjoining the piping seam. The particular length of the incision corresponds substantially to the width of the piping.

Further, another piping segment is inserted between the cloth parts along the cloth-pouch lateral edges adjoining the first piping edge, which points inward said pouch, the particular second opposite edge essentially terminating flush with the outer edge of the cloth pouch, the piping segments being made to overlap the first piping edge in the lengthwise direction of the incisions and pointing outward, that is, outward from the gap between the two cloth parts.

Next the further piping segments are sewn together between their first and second edges while simultaneously the particular lateral edges of the cloth pouch are sewn together with the cloth parts to form the unilaterally open cloth pouch.

When used with for instance down fillings or the like, the completely sewn "inside-out" cloth pouch is then turned outwardly, as a result of which the piping edge that pointed into the cloth pouch during the manufacture now points outward and appropriately optically covers the particular seam of the cloth pouch.

In the sense of the present invention, the concept of "piping" basically covers all kinds of piping materials, whether a tape piping, a round piping or a cord piping, both the tape and round pipings as a rule consisting of a multi-layer material with a suitable core. In preferred implementations of the invention however, a piping in the form of weatherstripping with a beaded first edge shall be used, the second edge being flat in the binding zone. The advantage of this kind of piping is foremost that on one hand the beaded edge offers aesthetic covering of the seam and on the other hand the flat binding zone makes possible secure affixing of the piping into the gap between the two cloth parts.

To assure tightly fitting the piping against the cloth-pouch edge, said piping preferably shall be stitched against or at least slightly inside the beaded piping edge.

Basically one seam suffices in the present invention to affix the particular piping segment and to seal the cloth-pouch lateral edges. However, and especially to prevent fraying the piping and or the cloth parts, another mode of implementation provides that the outer edge of the cloth pouch is held together with the associated second edge of the particular piping by a looping or securing seam. Preferably this looping or securing seam is manufactured substantially simultaneously, that is in one operation, with the associated parallel piping seam.

Basically the cloth pouch of the invention can be made manually in the above described procedure, for instance the pre-cut cloth parts being superposed individually, the piping segments of proper lengths being inserted and then the seams being made. However with respect to rationalized mass production, the cloth pouches of the invention are manufactured automatically in suitable equipment, for instance on a suitable sewing transfer line.

In this latter procedure, both the first and the second cloth parts and the first piping or piping segment are preferably fed in continuous manner from conveyor or feed roller and are moved into the corresponding stitching position. In particular the first, i.e. the piping edge or cloth-pouch edge of a longitudinal edge to be sewn first as seen in the direction of advance of the continuous lengths of cloth, corresponds in particular to a weaving edge.

After the two cloth parts have been positioned and after the first piping has been inserted in continuous manner, the piping and the cloth parts also are sewn together in continuous manner and where called for are looped. Thereupon preferably and following sewing and where called for looping of the first piping segment, the cloth parts forming the cloth pouch are cut off substantially transversely to said piping edge to the desired size in relation to the width of the finished cloth pouch.

In a further mode of implementation, the cloth pouch sealed on one side and fitted with the first piping segment is then moved inside the manufacturing equipment essentially transversely to the longitudinal direction of the continuous cloth materials and thereby transversely to the first piping seam, the two further piping segments preferably being stitched simultaneously and essentially transversely to the first piping edge and to the feed direction of the continuous cloth material along the cut edges of the cloth pouch. Preferably again, the further piping segments are supplied initially in continuous manner from a roll and then are cut.

Preferably the incisions in one of the cloth parts along, i.e. parallel to the first piping seam of both cloth-pouch lateral edges and required for the overlapping piping configuration of the piping segments near the cloth-pouch corners, shall be carried out using cutting blades each entering the gap between the two cloth parts, one such blade being mounted in the area of each lateral edge. Basically it is enough that the blades shall enter the gaps between the cloth parts only when the incision is required, that is, when the corners reach the blade areas.

Preferably, however the rigidly mounted blades shall enter the gaps between the cloth parts by an amount essentially corresponding to the cutting length of the piping width, and they shall be configured in such manner that when advancing the cloth pouch toward the blades, the incisions are performed automatically once the first piping seam moves toward the blades.

BRIEF DESCRIPTION OF THE DRAWINGS

The invention is elucidated below by illustrative embodiment modes shown in the drawing.

DESCRIPTION OF THE PREFERRED EMBODIMENTS

Figure 1:
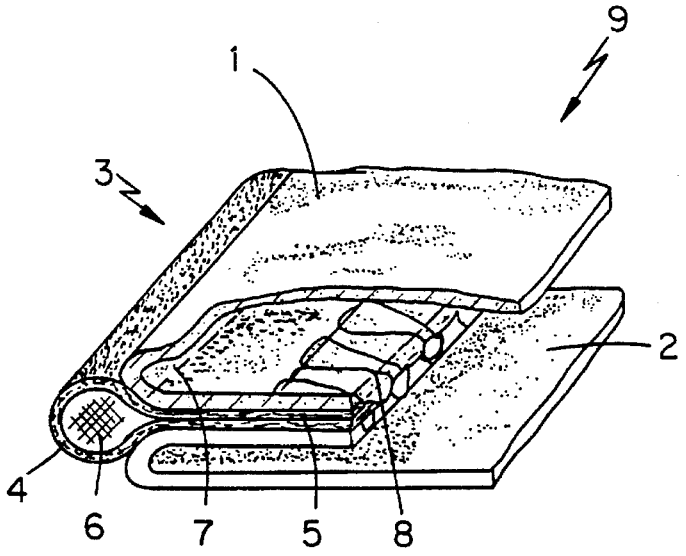
FIG. 1 is a perspective of a schematic piping seam in the everted condition of the cloth pouch of the invention.

FIG. 1 shows a cross-section of a piping segment, used both in the known cloth pouches and in those of the invention, in the final, everted state of a fabric pouch. The cloth pouch 9 is shown merely schematically and comprises two cloth parts 1 and 2 which are sewn together at their edges by a piping seam 7 with an inserted piping 3.

This piping 3 is in the form of weatherstripping and consists essentially of a longitudinally folded band, comprising a first, beady edge 4 formed by a fibrous inset and a flat affixing edge 5 entering the gap between the cloth parts 1, 2. This piping 3 is configured in such manner by means of the piping seam 7 that the beady edge 4 optically covers the seam from the outside and that the flat affixing edge 5 in the cloth pouch 9 is flush with the edges of the cloth parts 1, 2.

Figure 2:
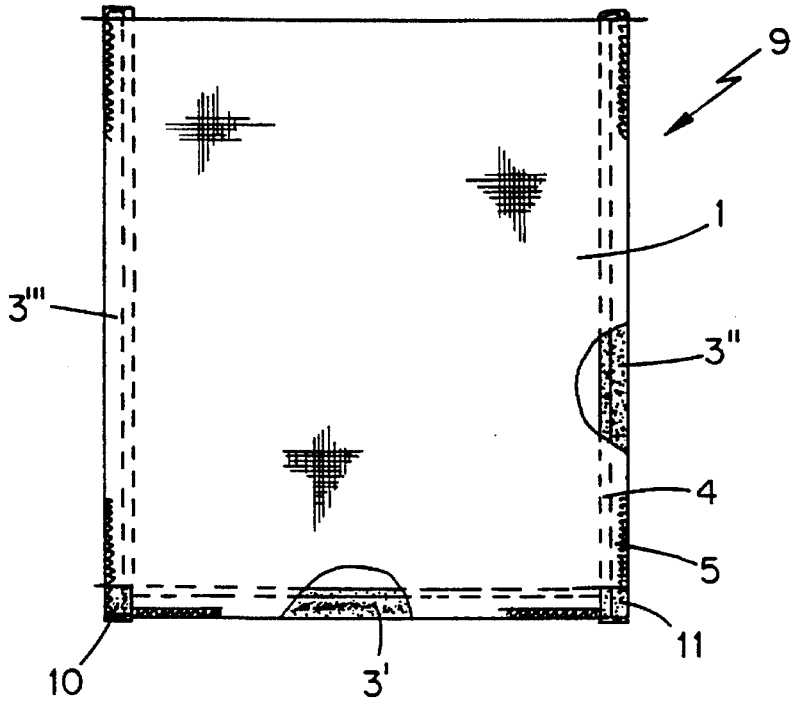
FIG. 2 is a topview of a cloth pouch of the invention with three piping seams and one open side shown in the everted, finished state.

The fabric pouch 9 is in its inside-out state during manufacture in the manner illustrated in FIG. 2. Only the upper cloth part 1 is shown in FIG. 2, but the two cloth parts 1, 2 are superposed with insertion between them of the piping segments 3', 3" and 3'" and are sewn together. Cross-sectionally this piping configuration corresponds to the representation of FIG. 1, however the cloth parts 1 and 2 are tipped to the left, whereby the looped edge 8 points outward and the beady piping edge 4 enters the inside of the cloth pouch 9.

Figure 3:
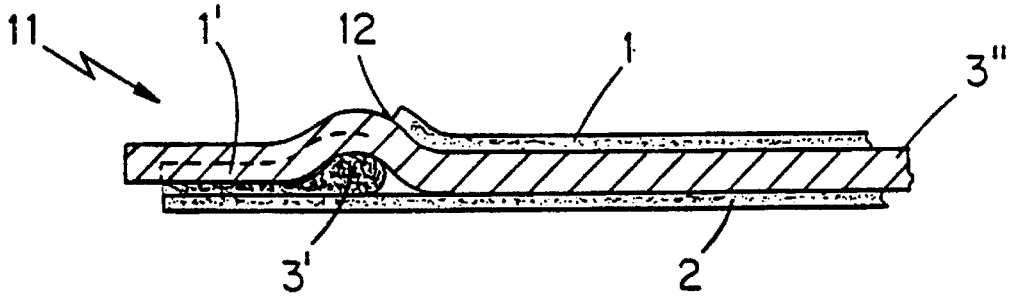
FIG. 3 is a cross-section of a piping seam near a corner and in the everted, finished state.

Again as shown by FIG. 2 and especially by FIG. 3, the piping segments 3' and 3''', and 3' and 3'' overlap at the corners 10 and 11 resp. of the cloth pouch 9, the piping segments 3'' and 3''' projecting beyond the piping segment 3'. Details will be discussed next in relation to the corner 11 shown in cross-section in FIG. 3.

As indicated by FIG. 3, overlap of the piping segments 3' and 3'' is possible at the corner 11 only if the piping segment 3'' is outside the stitching gap between the cloth parts 1, 2. For that purpose, the upper cloth part 1 comprises an incision 12 extending from the edge of the cloth pouch 9 over essentially the full width of the piping segment 3'' into the cloth part 1 along the beady edge 4 of the piping 3 and parallel to the piping edge. The piping segment 3'' passes outward and upward through this incision 12 and overlaps the first piping segment 3' while the segment 1' of the upper cloth part 1 lies underneath and is stitched to said segment 3''. The corner 10 is configured in similar manner.

Figure 4:
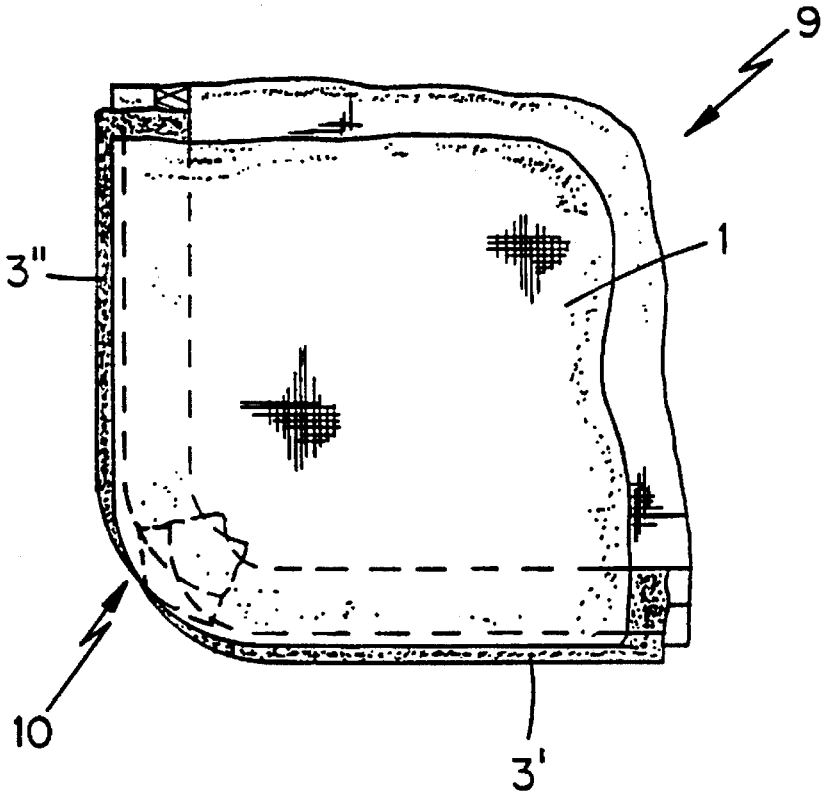
FIG. 4 is a schematic topview of a corner of a cloth pouch of the invention in the everted, final state, FIG. 5 schematically shows a sewing transfer line to manufacture a cloth pouch of the invention, and FIG. 6 also schematically shows the sequence in the sewing transfer line of FIG. 5 near a corner with corresponding piping overlap for a cloth pouch of the invention.

Once the cloth pouch 9 has been turned, a corner configuration is achieved in the zone of the corners 10 and 11 in the manner illustratively shown by FIG. 4 for the corner 10. A rounded edge with nearly continuous piping is achieved on account of the overlap, and esthetically and functionally this edge matches the manually stitched piping edge.

Figure 5:
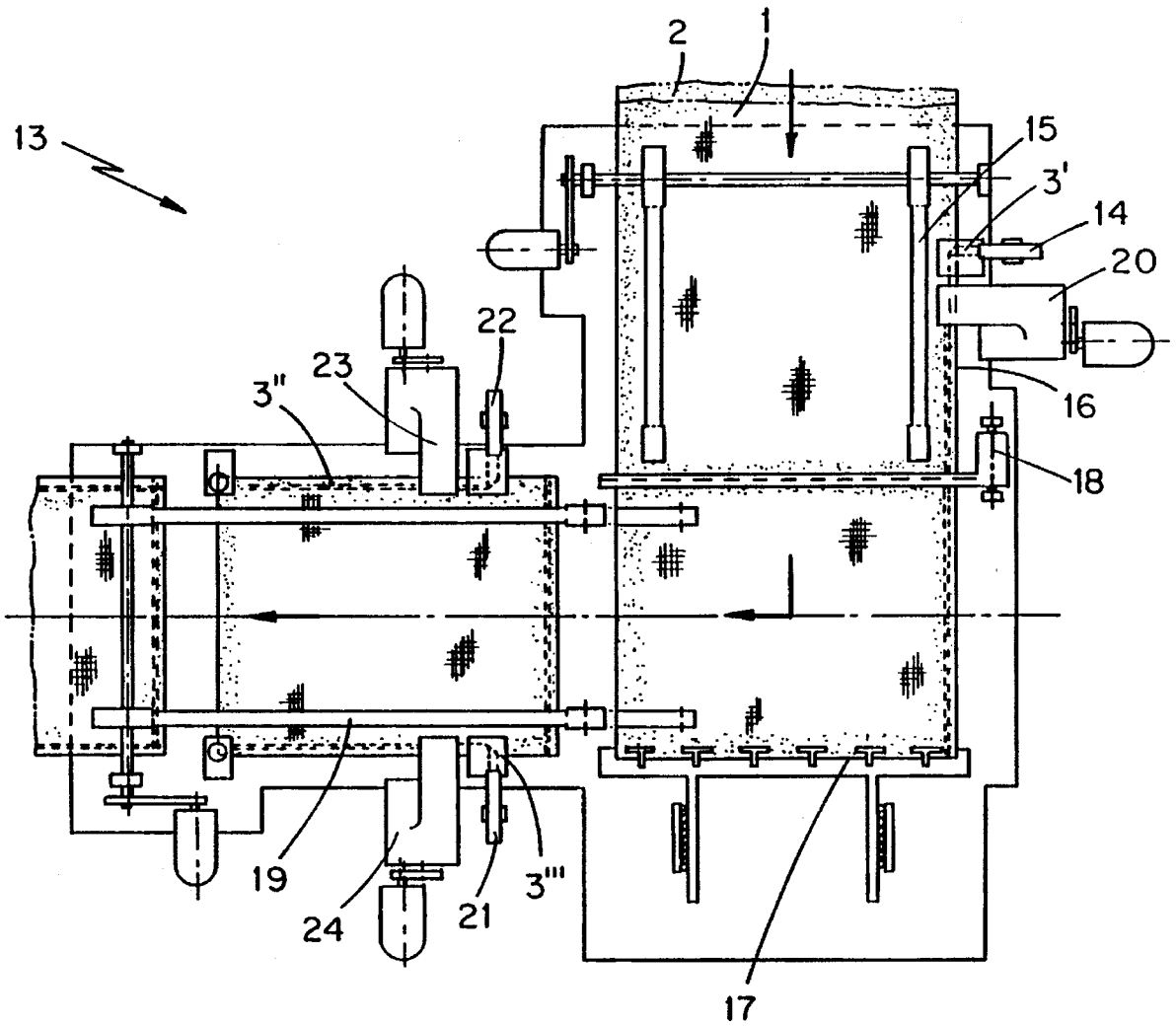

FIG. 5 shows a sewing transfer line 13 to carry out the method of the invention. The cloth parts 1 and 2 are fed in the form of continuous materials from omitted supply rolls to the equipment in such manner that said materials are superposed with a gap between them. The materials are moved into the equipment by a device symbolically denoted by 15. The arrows show the direction of advance of the cloth parts 1, 2.

A first feed system 14 supplies a first piping strip 3' into the gap between the cloth materials in the area of the edge 16, said strip 3' being sewn as such by the sewing machine 20 while being moved through the equipment. Upon reaching the first end position defined by the shown position of the edge 17, the superposed cloth materials stitched to the piping 3' are cut by a severing device 18 to the desired width of the cloth pouch 9.

A second conveyor means symbolically denoted by 19 next moves the cloth pouch 9, already sealed on one side, essentially transversely to the previous direction of advance. Piping segments 3'' and 3''' are continuously inserted by feed devices 21 and 22 into the gap between the cloth parts 1, 2 of the cloth pouch 9 where, during further advance, they are stitched by the sewing machines 23 and 24 with simultaneous sealing of the lateral edges of the cloth pouch 9.

After the cloth pouch 9 has moved along its entire length of edge through the sewing stations 23 and 24, the finished cloth pouch 9 is evacuated from the manufacturing equipment and moved for instance to an omitted stacking or packaging machine.

The stitching of the piping edges in the above discussed equipment is elucidated below in relation to FIGS. 6*a* through 6*d*.

Figure 6A:
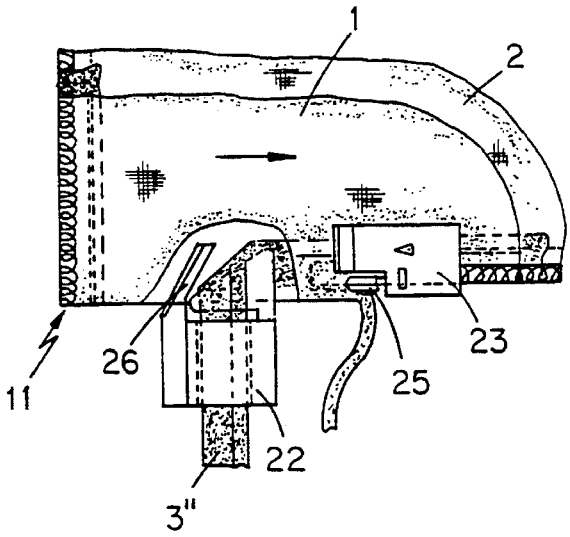
Figure 6B:
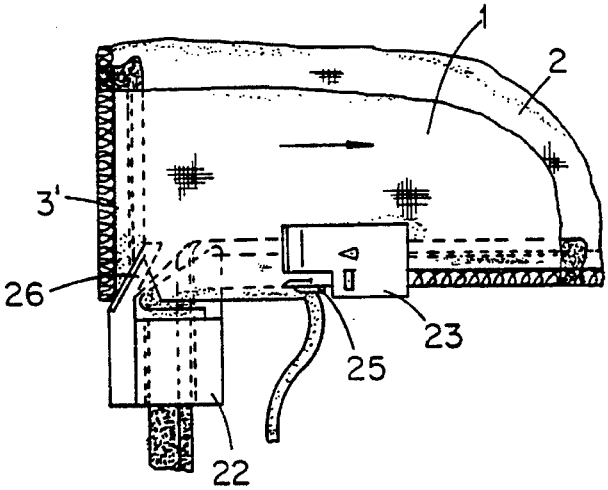
Figure 6C:
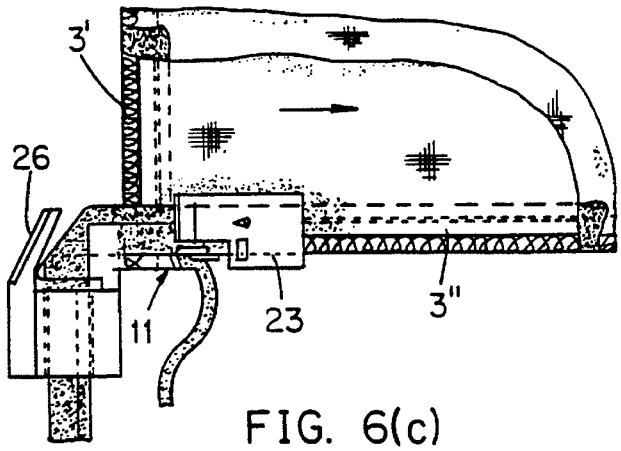
Figure 6D:
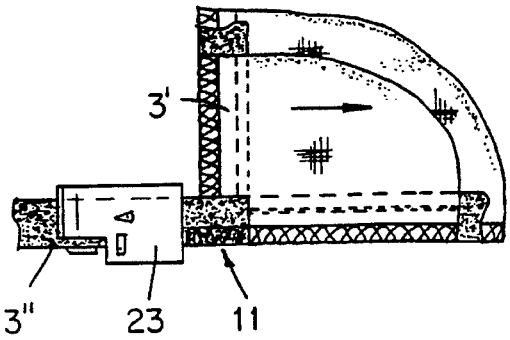

FIG. 6*a* shows the insertion stage of the continuous piping 3'' by means of the feed device 22 in the vicinity of the edge of the cloth pouch 9. As soon as the piping strip 3'' is inserted, it is stitched and looped together with the associated edge zones of the cloth parts 1 and 2 by the sewing machine 23 and is trimmed by a cutter 25.

The feed device 22 supplying the piping strip 3'' comprises a stationary cutting blade 26 at its front side opposite the direction of advance of the cloth pouch 9 indicated by an arrow, said blade projecting by the amount of the piping width into the gap between the cloth parts 1 and 2. However, in the stage shown in FIG. 6*a*, the cloth parts slip over or underneath this blade which in this stage is not operational.

As shown by FIG. 6*a*, as the cloth pouch 9 is advanced further, the blade 26 shall hit the first piping strip 3' when the end of the cloth pouch 9 has been reached. Because of a slightly upward attitude of the blade 26, further advance automatically causes an incision 12 open toward the lateral edge in the first piping strip 3', the feed device 22, ie its front edge, causing the piping strip 3'' to exit from the gap between the cloth parts 1 and 2 through the incision 12 (also see FIG. 6*c*) while overlapping the piping strip 3' in the area of the corner 11.

Lastly the sewing machine 23 also stitches and loops the piping strip 3'' and 3' in the area of the edge 11, said strip then being cut off.

We claim:

1. A method for manufacturing a sealable cloth pouch having an opening on one side and consisting of two cloth parts to be sewn together in inside-out processing with a peripheral piping stitched in-between the cloth parts along an edge of said sealable cloth pouch comprising the steps of:

(a) inserting a first piping segment (3') between bottom lateral edges of two cloth parts (1, 2) superimposed to form a cloth pouch (9), a first edge (4) of the first piping segment (3') pointing inward and an opposite edge (5) of the first piping segment (3') essentially being flush with an outer bottom edge of the cloth pouch (9), (b) stitching together the first piping segment (3') between its first and opposite edges (4 and 5) and the bottom lateral edges of the two cloth parts (1 and 2) to form a first piping edge, (c) making an incision in one (1) of the cloth parts at each end of the bottom outer edge of the cloth pouch (9), a length of each such incision (12) substantially matching a width of the first piping segment (3'), (d) inserting a pair of piping segments (3'', 3''') between the cloth parts (1, 2) along lateral side edges of the cloth pouch (9) which adjoin the first piping edge, the first edges (4) of the piping segment (3'', 3''') pointing inward toward said cloth pouch (9), the opposite edge (5) substantially ending flush with an outer edge of the cloth pouch (9) and the pair of piping segments (3'', 3''') being made to pass outward over the first piping edge] through the incision (42), and (e) sewing together the pair of piping segments (3', 3''') between first and second edges (4, 5) thereof and the lateral sides edges of the cloth pouch (9) to form second and third piping edges.

2. Method defined in claim 1, wherein each of the first and the pair of piping segments (3', 3'' and 3''') have a beady first edge (4) and a second, flat, affixing edge (5).

3. Method defined in claim 2, wherein each of the first and the pair of piping segments (3', 3'' and 3''') are stitched directly on or at least slightly into the beady edge (4).

4. Method defined in claim 1 wherein the outer edge of the cloth pouch (9) together with the opposite edge (5) of each of the first and pair of piping segments (3', 3'' and 3''') is enclosed by an edge-securing stitch.

5. Method defined in claim 4, wherein the edge securing stitch is made essentially simultaneously with the stitching and sewing steps in (b) and (d).

6. Method defined in claim 1 wherein the first and second cloth parts (1 and 2,) and the first piping segment (3') are supplied in a continuous manner for said inserting and stitching steps.

7. Method defined in claim 6, wherein the first piping edge corresponds to one longitudinal edge of the cloth parts (1, 2) in relation to a direction of advance during said continuous supply.

8. Method defined in claim 6 wherein, following the stitching of the first piping edge, the cloth parts (1, 2) forming the cloth pouch (9) are cut off substantially transversely to ends of said first piping edge to form a desired width of the cloth pouch (9).

9. Method defined in claim 8, wherein the second and third piping edges are stitched along edges cut substantially transversely to the first piping edge.

10. Apparatus for manufacture of a unilaterally open, sealable cloth pouch consisting of two cloth parts to be sewn together while in an inside-out position with peripheral piping sewn along the edges between the cloth parts, comprising:

(a) a device to feed cloth parts (1, 2) to be sewn together, (b) a device (14) to insert a first piping segment (3') between bottom lateral edges of the two cloth parts (1, 2) superposed to form a cloth pouch (9) whereby a first edge (4) of the first piping segment (3') points inward and an opposite edge (5) of the first piping segment (3') terminates essentially flush with an outer bottom edge of the cloth pouch (9) to be formed, (c) a device (20) to stitch together the first piping segment (3') between its first and opposite edges (4,5) and the bottom lateral edges of the cloth pouch (9) to form a first piping edge, (d) a device (26) to create an incision in one (1) of the cloth parts at ends of the bottom outer edge of the cloth pouch (9), whereby a length of each incision (12) substantially matches a width of the first piping segment (3'), (e) a device (21, 22) to insert pair of piping segments (3", 3''') between the cloth parts (1, 2) along lateral side edges of the cloth pouch (9) that adjoin the first piping edge, whereby the first edges (4) of the piping segments (3", 3''') points inside the cloth pouch (9) and the opposite edges (5) substantially terminates flush with an outer edge of the cloth pouch (9), and each of the pair of piping segments (3", 3''') are made to pass through respective incisions (12) outward over the first piping edge, and (f) a device (23, 24) to sew together each of the pair of piping segments (3", 3''') between first and second edges (4, 5) thereof and lateral side edges of the cloth pouch (9).

11. Apparatus defined in claim 10, wherein the device to feed both the first and the second cloth parts (1 and 2 resp) and the device to insert the first piping segment (3') each comprises one of a conveyor and a feed roller.

12. Apparatus defined in claim 10, wherein the device to create the incisions (12) into one of the cloth parts (1) further comprises a cutting blade (26) parallel to the first piping edge.

13. Apparatus defined in claim 12, wherein the cutting blades (26) enter in rigid, stationary manner a gap between the cloth parts (1, 2) and make an incision length which is substantially a width of the piping segments and are so configured that during the advance of the cloth pouch (9) against the blades (26), the incisions (12) are automatically created once the first piping edge moves against the blades.

14. A unilaterally open, sealable cloth pouch consisting of two sewn-together cloth parts with an essentially peripheral piping sewn-in between the cloth parts at their edges, characterized in that the peripheral piping consists as a whole of one separate piping segment for each lateral edge of the cloth pouch, where, in an inside-out state of the cloth pouch, the piping segments adjoining a first piping edge which is opposite an open side of the cloth pouch are each made to pass from a gap between the cloth parts through an aperture in one of the two cloth parts and over the first piping edge to the outside, or, wherein a piping segment of the first piping edge is made to pass outward of each end thereof and through an aperture in one of the two cloth parts, each end passing over an adjoining piping edge of one of said adjoining piping segments.

* * * * *